US007324055B2

(12) United States Patent
Wan

(10) Patent No.: US 7,324,055 B2
(45) Date of Patent: Jan. 29, 2008

(54) ANTENNA HAVING WIDE TRANSMITTING ANGLE

(75) Inventor: Tze Chung Wan, Tauyuan Hsien (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 0 days.

(21) Appl. No.: 11/410,464

(22) Filed: Apr. 25, 2006

(65) Prior Publication Data

US 2007/0247382 A1 Oct. 25, 2007

(51) Int. Cl.
*H01Q 21/00* (2006.01)

(52) U.S. Cl. ..... 343/725; 343/729

(58) Field of Classification Search ..... 343/725, 343/729, 702, 711, 713
See application file for complete search history.

(56) References Cited

U.S. PATENT DOCUMENTS

| | | | | |
|---|---|---|---|---|
| 6,181,286 | B1 * | 1/2001 | Roscoe et al. | 343/725 |
| 6,417,809 | B1 | 7/2002 | Kadambi et al. | 343/702 |
| 6,806,838 | B2 * | 10/2004 | Petros et al. | 343/725 |
| 6,906,670 | B2 | 6/2005 | Shi | 343/702 |

* cited by examiner

*Primary Examiner*—Hoang V. Nguyen
(74) *Attorney, Agent, or Firm*—Charles E. Baxley

(57) ABSTRACT

An antenna device includes a seat, a longitudinal antenna member having a lower portion disposed on the seat, and a cylindrical antenna member having a lower portion disposed on the seat and having a chamber formed by an outer peripheral wall, and the longitudinal antenna member is disposed in the chamber of the cylindrical antenna member and spaced from the outer peripheral wall of the cylindrical antenna member for a distance, and the longitudinal antenna member includes an upper portion extended outwardly beyond the cylindrical antenna member. The antenna members may be used for receiving and transmitting signal of different frequencies.

6 Claims, 5 Drawing Sheets

ANTENNA HAVING WIDE TRANSMITTING ANGLE

BACKGROUND OF THE INVENTION

1. Field of the Invention

The present invention relates to a wireless telecommunicating antenna, and more particularly to an antenna device having different antenna members for wireless telecommunicating purposes and for receiving and transmitting different signals or different frequencies.

2. Description of the Prior Art

Typical antenna devices comprise an antenna disposed on or applied onto one side of a printed circuit board (PCB), for receiving and transmitting electric signals. Some of the typical antenna devices may further comprise a metal sheet disposed on or applied onto the other side of the PCB, for grounding purposes.

However, the antenna is disposed on one side of the PCB, and the magnetic field generated by the antenna may be polarized, such that the antenna may have two poles or two dead ends or dead corners where electric signals may not be suitably received and transmitted.

For solving the signals receiving and transmitting problems, some of the typical antenna devices comprise an antenna attached onto one side of a PCB with one or more legs, to suitably space the antenna from the PCB, and to allow electric signals to be suitably received and/or emitted or transmitted by the typical antenna devices. However, the typical antenna device may be used for receiving and transmitting signals of one frequency only.

U.S. Pat. No. 6,417,809 to Kadambi et al discloses another typical antenna device comprising two planar inverted F antennas attached to a printed circuit board and spaced away from each other for forming a compact dual diversity antenna for radio frequency (RF) data. However, there are two planar inverted F antennas required to be attached to the printed circuit board separately, but may not be easily and quickly attached or coupled to the printed circuit board.

U.S. Pat. No. 6,906,670 to Shi discloses a further typical antenna or card device having antenna of two or more frequencies, in which the antenna includes one extension to receive and transmit signals of a frequency, and another extension to receive and transmit signals of a different frequency.

However, the typical antenna also comprises a planar structure, such that the signal receiving and/or emitting or transmitting angle is limited, and such that the typical antenna devices also may not be used to suitably receive and/or emit or transmit the signals.

The present invention has arisen to mitigate and/or obviate the afore-described disadvantages of the conventional antenna devices.

SUMMARY OF THE INVENTION

The primary objective of the present invention is to provide an antenna device including two antenna devices superposed or attached together, for receiving and transmitting signals toward different directions and for receiving and transmitting different signals or different frequencies.

In accordance with one aspect of the invention, there is provided an antenna device comprising a seat, a first antenna member including a lower portion disposed on the seat, and a second antenna member also including a lower portion disposed on the seat, and including a chamber formed therein and defined by an outer peripheral wall, and the first antenna member is disposed in the chamber of the second antenna member and spaced from the outer peripheral wall of the second antenna member for a distance, and the first antenna member includes an upper portion extended outwardly beyond the second antenna member for receiving and transmitting a signal of a frequency different from a signal frequency of the second antenna member.

The seat includes an outer peripheral shoulder formed thereon for forming a protrusion, and the second antenna member includes a lower portion engaged onto the protrusion of the seat and engaged with the outer peripheral shoulder of the seat for allowing the protrusion of the seat to be engaged into the chamber of the second antenna member relatively.

The seat includes a bore formed therein for partially receiving the lower portion of the first antenna member. A base board may further be provided for supporting the first and the second antenna members and the seat and for signal reflective purposes. The base board includes a coupler disposed on a lower portion of the base board for coupling to electrical facilities.

The base board includes a spacer disposed on an upper portion of the base board and attached to the seat for spacing the seat from the base board. The base board includes a conductor disposed in the spacer and having an upper portion coupled to the seat and the first antenna member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
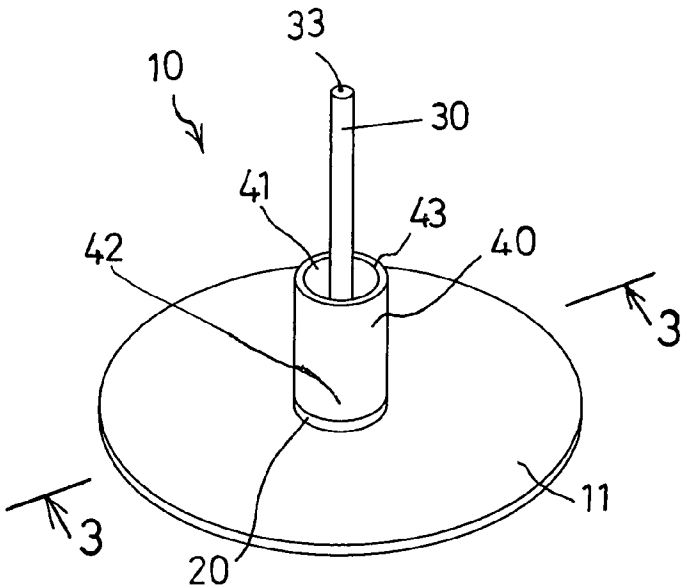
FIG. 2 is a perspective view of the antenna device.
Figure 1:
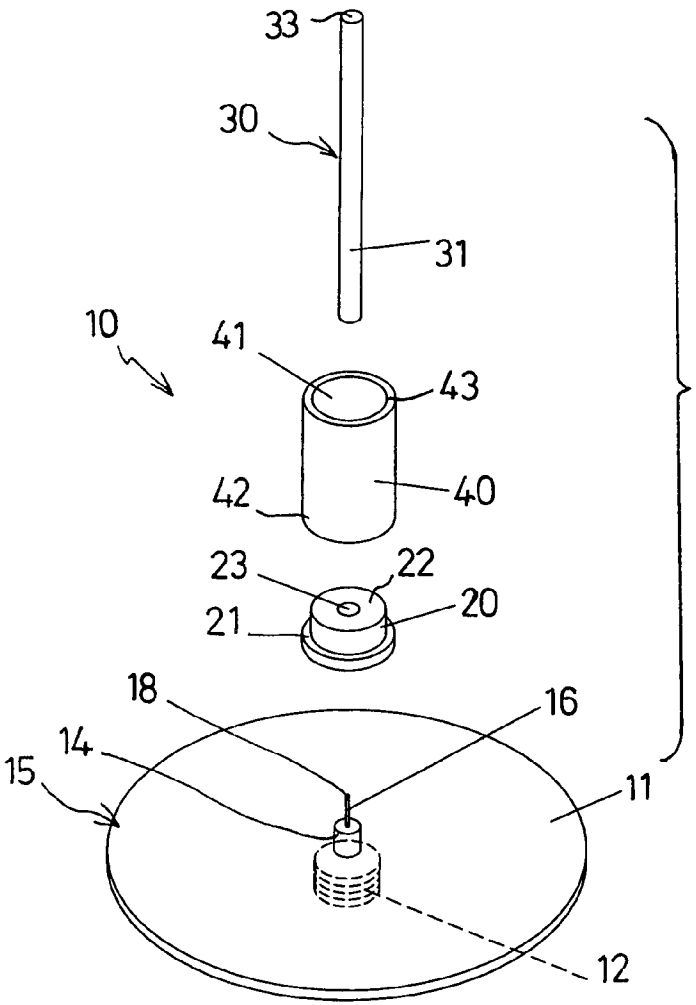
FIG. 1 is a partial exploded view of an antenna device in accordance with the present invention.
Figure 3:
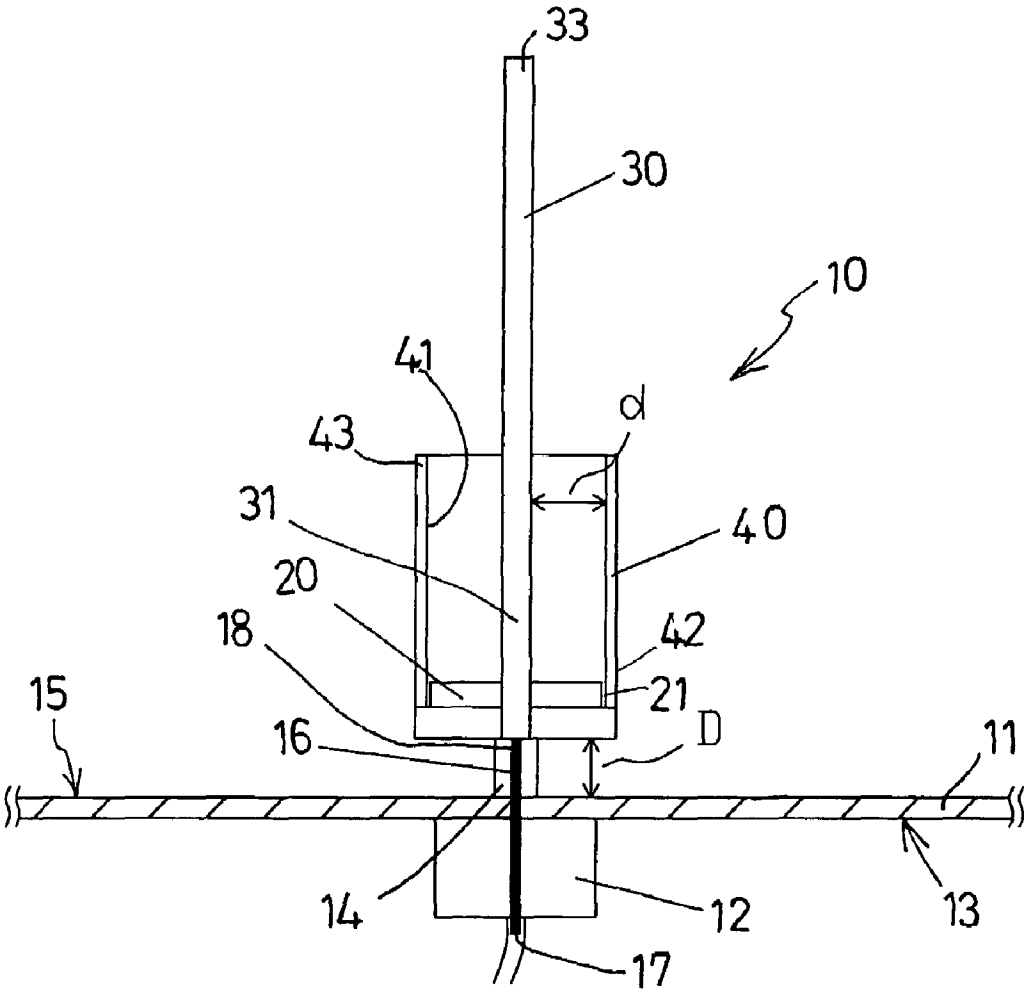
FIG. 3 is a partial cross sectional view of the antenna device, taken along lines 3-3 of FIG. 2.

Referring to the drawings, and initially to FIGS. 1-3, an antenna device 10 in accordance with the present invention comprises a base board 11 made of such as metal materials, for such as signal reflective purposes and for increasing the signal emitting and/or receiving or transmitting angles or ranges for the antenna device 10, a coupler 12 disposed or attached to the base board 11, such as secured to the bottom portion 13 of the base board 11 for coupling or mounting to various kinds of electrical facilities (not shown), and a column or spacer 14 disposed or attached to the base board 11, such as secured to the upper portion 15 of the base board 11.

A terminal or electric wire or cable or conductor 16 is disposed in or engaged through the coupler 12 and/or the spacer 14 of the base board 11, and includes a lower portion 17 for coupling or attaching to the electrical facilities, and includes an upper portion 18 extended upwardly and outwardly through the spacer 14. A seat 20 is disposed on the spacer 14 and secured to the spacer 14 with such as latches or fasteners (not shown) or adhesive materials, or by welding processes, and electrically connected to the upper portion 18 of the conductor 16. The seat 20 may thus be supported on the base board 11 and spaced from the base board 11 for a suitable or selected distance D by the spacer 14 (FIG. 3).

It is preferable that the seat 20 includes an outer peripheral shoulder 21 formed thereon for forming a central protrusion 22 that includes a relatively decreased outer diameter, or that includes an outer diameter smaller than the outer diameter of the seat 20, and the seat 20 includes a bore 23 formed therein and aligned with the upper portion 18 of the conductor 16 for partially receiving the upper portion 18 of the conductor 16. The seat 20 is also made of conductive materials for signal transmitting purposes or for allowing the signal to be transmitted between the conductor 16 and the seat 20.

The antenna device 10 further includes a first or longitudinal antenna member 30 having a lower portion 31 engaged into the bore 23 of the seat 20 or secured to the seat 20, and electrically connected to the upper portion 18 of the conductor 16 and/or electrically connected to the seat 20 for signal emitting and/or receiving or transmitting purposes. For example, the antenna member 30 may be provided for emitting and/or receiving or transmitting data or signals of lower or less frequencies.

The antenna device 10 further includes a second or cylindrical antenna member 40 having a cylindrical configuration and having a cylindrical chamber 41 formed therein and defined by an outer peripheral wall 43 for allowing a lower portion 42 of the cylindrical antenna member 40 to be engaged onto the protrusion 22 of the seat 20, and/or engaged onto the outer peripheral shoulder 21 of the seat 20, and/or for allowing the protrusion 22 of the seat 20 to be engaged into the cylindrical chamber 41 of the cylindrical antenna member 40 relatively.

The cylindrical antenna member 40 is also electrically connected to the seat 20 and thus electrically connected to the upper portion 18 of the conductor 16 for signal emitting and/or receiving or transmitting purposes. For example, the cylindrical antenna member 40 may be provided for emitting and/or receiving or transmitting data or signals of greater or larger or higher frequencies, or for emitting and/or receiving or transmitting data or signals having frequencies different from or greater or higher than the frequencies for the first or longitudinal antenna member 30.

The first or longitudinal antenna member 30 may thus be received or engaged in the cylindrical chamber 41 of the cylindrical antenna member 40, such as engaged or located in the center portion of the cylindrical antenna member 40, and spaced from the outer peripheral wall 43 of the cylindrical antenna member 40 for a suitable or selected distance d (FIG. 3), and includes an upper portion 33 extended outwardly beyond the antenna member 40, or the antenna member 30 includes a height greater than that of the antenna member 40 for receiving and transmitting signals toward different directions. The distance d between the antenna members 30, 40 may be changed or determined by the outer diameter of the first or longitudinal antenna member 30 and/or by the outer diameter or the inner diameter of the cylindrical antenna member 40.

Figure 4:
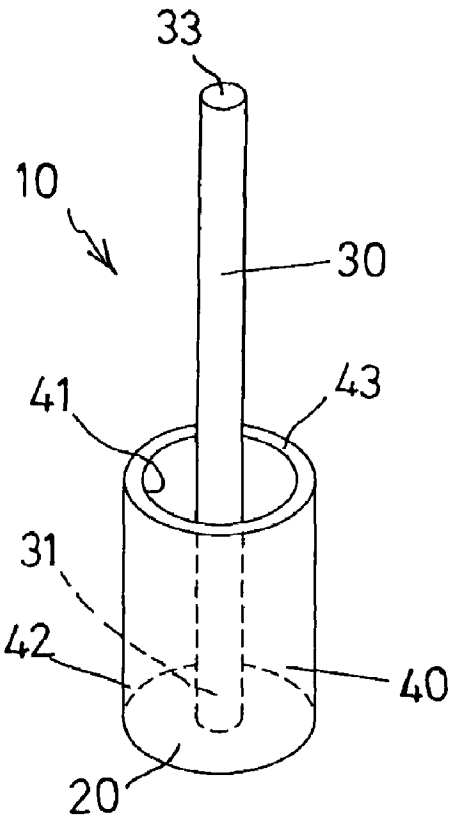
FIG. 4 is a perspective view illustrating another arrangement of the antenna device.

Alternatively, as shown in FIG. 4, the seat 20 and the first or longitudinal antenna member 30 and the lower portion 42 of the second or cylindrical antenna member 40 may be solidly formed or secured or coupled together for forming an integral-one-piece structure as shown in FIG. 4, for allowing the antenna device 10 to be easily and readily attached to various kinds of electrical facilities. The first or longitudinal antenna member 30 and the second or cylindrical antenna member 40 are also spaced from each other for a suitable or selected distance for receiving and transmitting different signals or different frequencies.

Figure 5:
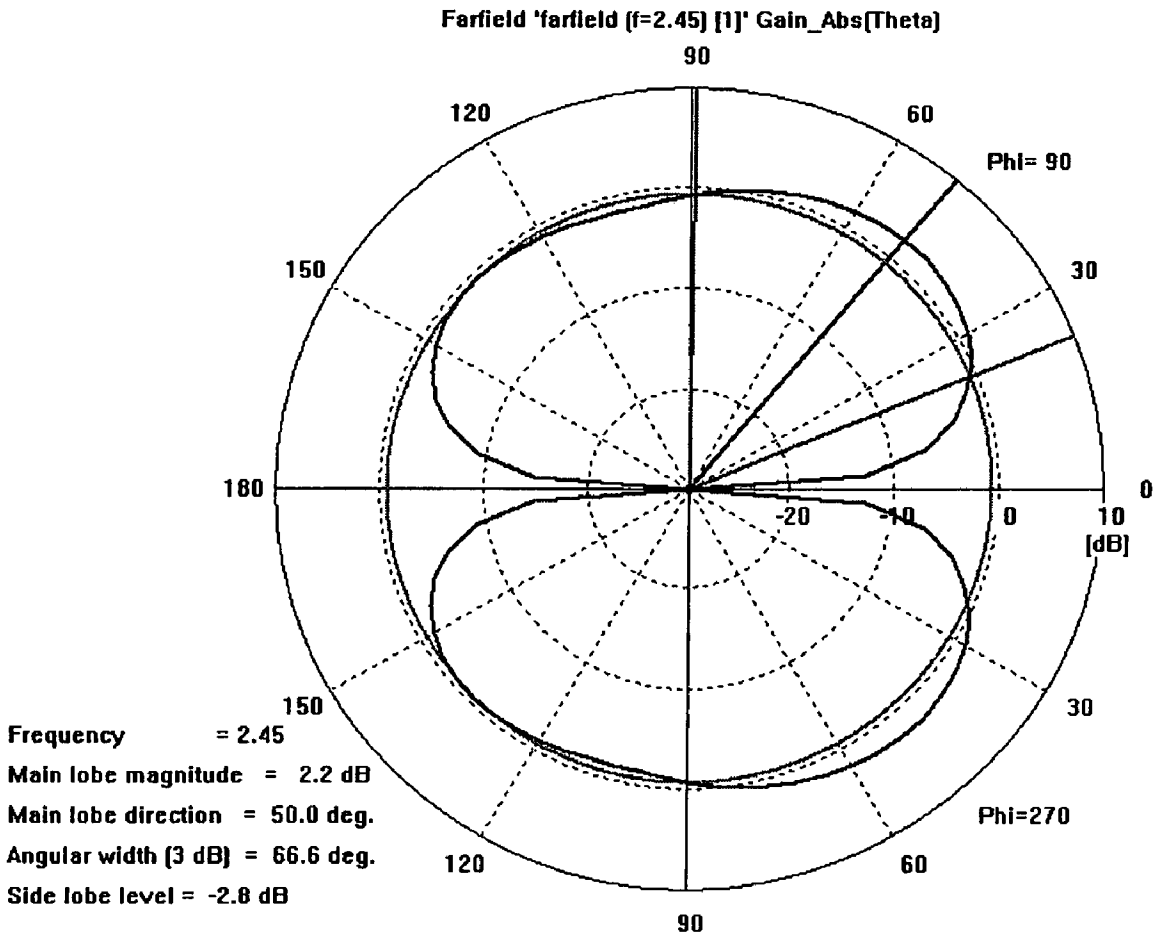
FIGS. 5, 6, 7 are diagrams illustrating the tests conducted by three different frequencies.
Figure 6:
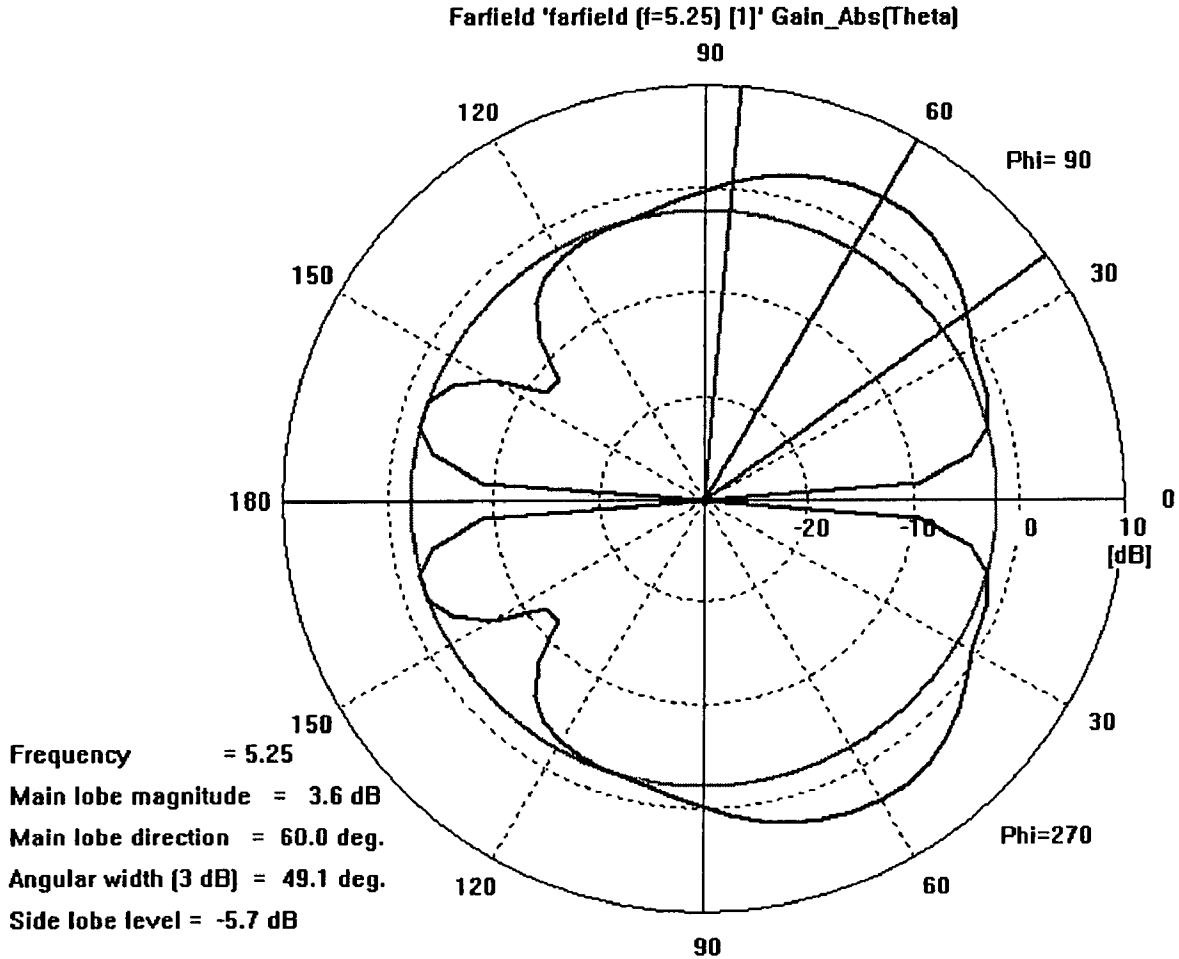
Figure 7:
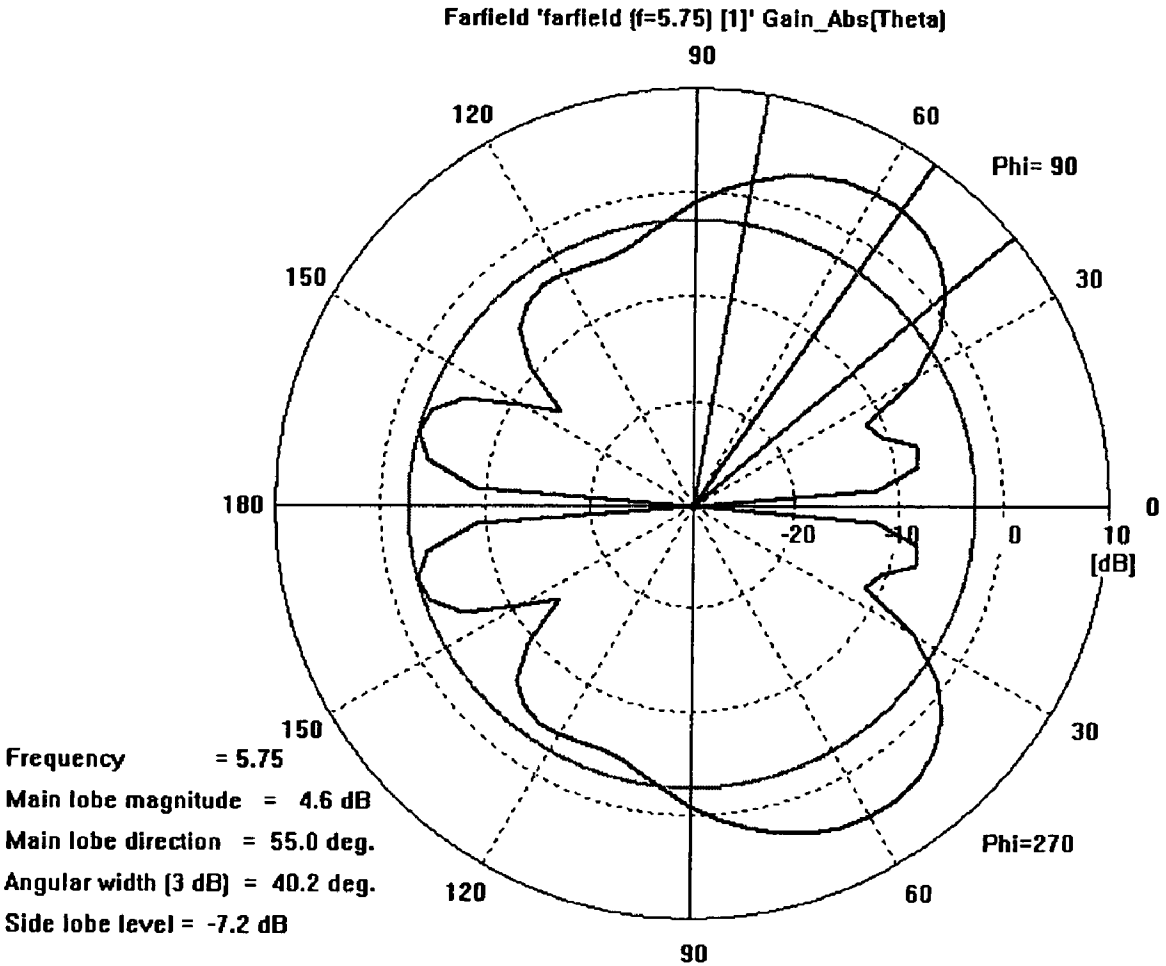

As shown in FIGS. 5, 6, 7, illustrated are the test results conducted with the antenna device 10 in accordance with the present invention under different frequencies. For example, as shown in FIG. 5, the test is conducted or operated under a frequency of 2.45, and the other tests, as shown in FIGS. 6, 7 are conducted or operated under a frequency of 5.25 and 5.75 respectively, in which the antenna device 10 may include excellent signal emitting and/or receiving or transmitting angles or ranges.

Accordingly, the antenna device in accordance with the present invention includes two antenna devices superposed or attached together, for receiving and transmitting signals toward different directions and for receiving and transmitting different signals or different frequencies.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna device comprising:

a seat including an outer peripheral shoulder formed thereon for forming a protrusion, a first antenna member including a lower portion disposed on said seat, and a second antenna member also including a lower portion disposed on said seat, and including a chamber formed therein and defined by an outer peripheral wall, and including a lower portion engaged onto said protrusion of said seat and engaged with said outer peripheral shoulder of said seat for allowing said protrusion of said seat to be engaged into said chamber of said second antenna member relatively, and said first antenna member being disposed in said chamber of said second antenna member and spaced from said outer peripheral wall of said second antenna member for a distance, and said first antenna member including an upper portion extended outwardly beyond said second antenna member for receiving and transmitting a signal of a frequency different from a signal frequency of said second antenna member.

2. The antenna device as claimed in claim 1, wherein said seat includes a bore formed therein for partially receiving said lower portion of said first antenna member.

3. The antenna device as claimed in claim 1 further comprising a base board for supporting said first and said second antenna members and said seat and for signal reflective purposes.

4. The antenna device as claimed in claim 3, wherein said base board includes a coupler disposed on a lower portion of said base board for coupling to electrical facilities.

5. An antenna device comprising:

a seat, a first antenna member including a lower portion disposed on said seat, and a second antenna member also including a lower portion disposed on said seat, and including a chamber formed therein and defined by an outer peripheral wall, said first antenna member being disposed in said chamber of said second antenna member and spaced from said outer peripheral wall of said second antenna member for a distance, and said first antenna member including an upper portion extended outwardly beyond said second antenna member for receiving and transmitting a signal of a frequency different from a signal frequency of said second antenna member, and a base board for supporting said first and said second antenna members and said seat and for signal reflective purposes, said base board including a spacer disposed on an upper portion of said base board and attached to said seat for spacing said seat from said base board.

6. The antenna device as claimed in claim 5, wherein said base board includes a conductor disposed in said spacer and having an upper portion coupled to said seat and said first antenna member.

* * * * *